US006997454B2

(12) United States Patent
Antonelli et al.

(10) Patent No.: US 6,997,454 B2
(45) Date of Patent: Feb. 14, 2006

(54) PADDLE AND PADDLE SUPPORT IN ON-EDGE MAIL STACKERS

(75) Inventors: Nicholas Antonelli, Bethel, CT (US); Gary W. Comstock, New Milford, CT (US); Neil J. Kennedy, Woodbury, CT (US); Kevin J. O'Dea, Southbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 306 days.

(21) Appl. No.: 10/321,226

(22) Filed: Dec. 17, 2002

(65) Prior Publication Data

US 2004/0113355 A1 Jun. 17, 2004

(51) Int. Cl.
*B65H 31/06* (2006.01)

(52) U.S. Cl. ..... 271/214; 271/213; 271/181

(58) Field of Classification Search ..... 271/213, 271/214, 181, 149, 150
See application file for complete search history.

(56) References Cited

U.S. PATENT DOCUMENTS 3,799,539 A * 3/1974 Del Rio ..... 271/188
3,811,549 A * 5/1974 Preisig ..... 198/419.2
4,524,965 A * 6/1985 Kulpa ..... 271/214
4,765,607 A * 8/1988 Zouzoulas ..... 271/177
5,104,114 A * 4/1992 Gillmann ..... 271/181
5,393,196 A * 2/1995 Bluemle ..... 414/790.2
5,429,249 A 7/1995 Belec et al.
5,524,876 A * 6/1996 Porter ..... 271/178
6,302,638 B1 * 10/2001 Eggebrecht et al. ..... 414/798.7
6,398,204 B1 6/2002 Keane et al.
6,588,743 B2 * 7/2003 Yap ..... 271/215

* cited by examiner

*Primary Examiner*—Donald P. Walsh
*Assistant Examiner*—Kaitlin Joerger
(74) *Attorney, Agent, or Firm*—Michael J. Cummings; Charles R Malandra, Jr.; Angelo N. Chaclas

(57) ABSTRACT

An on-edge stacker having a deck surface to support a vertical mail stack, which is allowed to expand from the upstream end to the downstream end. A paddle, movably mounted on a linear support member, is used to support the downstream end of the mail stack. The linear support member is positioned at a level lower than or substantially the same as the deck surface so that the mail can be swept from the deck surface from either longitudinal side of the stacker. A toggle switch is disposed near the downstream end so that when the paddle moved by the expanding stack reaches beyond a certain point, the toggle switch is triggered to indicate that the stack is full or almost full. The paddle has a wedge-shaped blade so that it can slide the stacked mailed on the deck surface without damaging the mail.

6 Claims, 7 Drawing Sheets

PADDLE AND PADDLE SUPPORT IN ON-EDGE MAIL STACKERS

TECHNICAL FIELD

The present invention relates generally to a mail stacking machine and, more particularly, to a stacker paddle in an on-edge mail stacker.

BACKGROUND OF THE INVENTION

A mass mailing system generally comprises a mail inserting machine and a mail stacking machine. The mail inserting machine includes an envelope feeder and an enclosure document supply section. The envelope feeder is used to feed envelopes, one at a time, to an envelope insertion station. In the enclosure document supply section, a plurality of enclosure feeders is used to release enclosure documents to a chassis. The released documents are then gathered, collated and pushed by a plurality of pusher fingers to the envelope insertion station for insertion. Mail inserting machines are known in the art. For example, Roetter et al. (U.S. Pat. No. 4,169,341) discloses a mail inserting machine wherein documents are released onto a continuous conveyor mechanism to be collected and collated in a continuous matter. After the enclosure documents are inserted into the envelopes, the filled envelopes are typically transported to another piece of equipment that seals the envelopes and affixes postage or prints a postage indicium on each envelope.

The filled envelopes are typically collected and loaded by an operator into mail trays or other forms of storage. This step in the mass mailing process has been found to be a "bottleneck". One way to assist the operator in eliminating the bottleneck is to use an envelope stacking machine to automatically collect the filled envelopes into a stack so that the operator can remove the filled envelopes in stacks. One of the commonly used envelope stackers is an on-edge stacking apparatus. For example, Keane et al. (U.S. Pat. No. 6,398,204) discloses a mail stacking machine where a belt turn-up unit is used to turn the filled envelope from a horizontally facing direction to a vertical or "on-edge" position. The vertically oriented envelope is driven by a segmented roller into the bottom of a vertical stack. Kulpa (U.S. Pat. No. 4,524,965) discloses an envelope stacking machine where a rotary displacement device is used to supply a resisting force to a stacker paddle. Belec et al (U.S. Pat. No. 5,429,249) discloses an on-line sorter, which comprises a plurality of on-edge stackers to collect the sorted mailpieces.

A typical stacking machine 1, as shown in FIG. 1, comprises a mailpiece input device 30, an incoming mailpiece moving device 40 and a stacking section 50. As shown in FIG. 1, the stacking section 50 has a stacking deck 52 to support a stack of mailpieces 20. An incoming mailpiece 10, which enters the stack section 50 from the input device 30 along a direction 310, is driven by the moving device 40 into the bottom of the stack 20. As more mailpieces 10 are added to the bottom the stack 20, the stack 20 expands or grows toward the downstream end of the stacking section 50. As the stack 20 expands, the pressure on the incoming envelope 10 increases. In order to relieve the stack pressure, a continuous conveyor belt 54 moving along a direction 320 is used to space out the stacked mailpieces, thereby making room for the next incoming mailpiece 10 to join the stack 20. At the same time, a paddle 60 is used to support the stack 20, preventing the top mailpieces of the stack 20 from falling toward the downstream end. The paddle 60 is linked to a bearing collar 70 by a handle 62. The collar 70 is movably mounted over a shaft or support rod 72 for movement. The support rod 72, which is substantially parallel to the moving direction 320, is fixedly mounted on rod mounts 74 and 76. The support rod 72, as shown in FIGS. 1 and 2, is positioned above the deck 52. As such, the support rod 72 hinders the free access needed to "sweep" or remove the stacked mail from the conveyor belt 54.

When the stacking machine 1 is used in conjunction with other equipment, such as a mail inserter, for a large-scaled mail operation, it is desirable that the stacked mail can be removed from both lateral sides of the stacking section 50. Thus, it is desirable and advantageous to provide a stacking machine wherein the mail stack 20 can be swept from either side of the stacking section.

A stacker paddle for on-edge mail stackers has traditionally been designed as a slidable member attached to a bearing or guiding journal element that is slidably fastened to a support rod or rail. The paddle is typically designed to be raised for mail sweeping and to be lowered onto the stacking deck afterward. As the paddle slices into the stack of remaining mailpieces, it tends to cause damage to the mailpieces on the stacking section. Thus, it is also desirable and advantageous to provide a stacker paddle that minimizes the damage to the stacked mail when the stacker paddle is dropped into the stack from its raised position.

SUMMARY OF THE INVENTION

It is a primary objective of the present invention to provide a stacker paddle support that does not interfere with sweeping a mail stack. This objective can be achieved by positioning the support rod below the surface of the deck of the stacking section. It is a further objective of the present invention to provide a stacker paddle that is less likely to cause damage to the mailpieces on a stacker when it slices into the mail stack on the stacking deck. The further objective can be achieved by providing a paddle having a wedge-shaped edge.

Thus, the first aspect of the present invention is a stacking machine for stacking a plurality of mailpieces into a stack. The stacking machine comprises:

- a stacking deck having
  - an upstream end,
  - a downstream end,
  - a deck surface to support the stack, the stack having a first end and an opposing second end adjacent to the upstream end, wherein the mailpieces in the stack are oriented in a direction substantially perpendicular to the deck surface, and wherein the mailpieces are driven into the second end of the stack for stacking, causing the stack to expand in an expansion direction from the upstream end toward the downstream end;
  - a first longitudinal side, and
  - a second longitudinal side as so to allow at least part of the stack to be removed from the deck surface either from the first or second longitudinal side;
- a support member having a longitudinal axis substantially parallel to the expansion direction of the stack, disposed on the first longitudinal side of the stacking deck; and
- a paddle, movably disposed on the support member, for supporting the first end of the stack, the paddle thereby is caused to move with the stack along the longitudinal axis of the support member as the stack expands, wherein the paddle is disengageable from the stack when said at least part of the stack is removed from the deck surface, and wherein the support member is disposed at a level lower than or substantially the same as the deck surface so as to facilitate the removal of said at least part of the stack from the deck surface from the first longitudinal side thereof.

Advantageously, the support member comprises a linear rod, and the paddle comprises a sliding member slidably mounted on the linear rod for linear movement along the longitudinal axis.

Alternatively, the support member comprises a linear track, and the paddle comprises a sliding member slidably mounted on the linear track for linear movement along the longitudinal axis.

Advantageously, the stacking machine further comprises a mechanism, operable either in a first position or a second position and adapted to indicate that the paddle is located near the downstream end beyond a pre-determined point, wherein the mechanism is caused by the paddle to operate in the first position when the paddle moves from the upstream end toward the downstream beyond the pre-determined point, and in the second position when the paddle returns from the downstream end beyond the pre-determined point to the upstream end.

Advantageously, the stacking machine further comprises a moving belt disposed above and adjacent the deck surface for supporting and moving the mailpieces in the stack from the upstream end toward the downstream as the stack expands, wherein the paddle has an edge, resting on the moving belt when the paddle is engaged with the stack, the edge having an elastomeric surface to index the moving belt surface.

Advantageously, the edge has a first edge end adjacent to the first longitudinal side of the stacking deck and a second edge end adjacent to the second longitudinal side, and wherein the edge is narrower in the first edge end than the second edge end.

The second aspect of the present invention is a method of facilitating removal of a mail stack in a stacking machine, wherein the stacking machine comprises:

a stacking deck having an upstream end, a downstream end, and a deck surface for stacking a plurality of mailpieces into a stack, the stack having a first end and an opposing second end adjacent to the upstream end, wherein the mailpieces in the stack are oriented in a direction substantially perpendicular to the deck surface, and the mailpieces are driven into the second end of the stack for stacking, causing the stack to expand in an expansion direction from the upstream end toward the downstream end, a first longitudinal side, a second longitudinal side as so to allow at least part of the stack to be removed from the deck surface either from the first or second longitudinal side, and a paddle for supporting the first end of the stack. The method comprises the steps of:

disposing a support member on the first longitudinal side of the stacking deck, the support member having a longitudinal axis substantially parallel to the expansion direction of the stack, and movably disposing the paddle on the support member so that the paddle can be caused to move with the first end of the stack as the stack expands, and the paddle is disengageable from the stack when at least part of the stack is removed from the deck surface, wherein the support member is disposed at a level lower than or substantially the same as the deck surface.

The present invention will become apparent upon reading the description taken in conjunction with FIGS. 3 to 7*b*.

BEST MODE TO CARRY OUT THE INVENTION

Figure 3A:
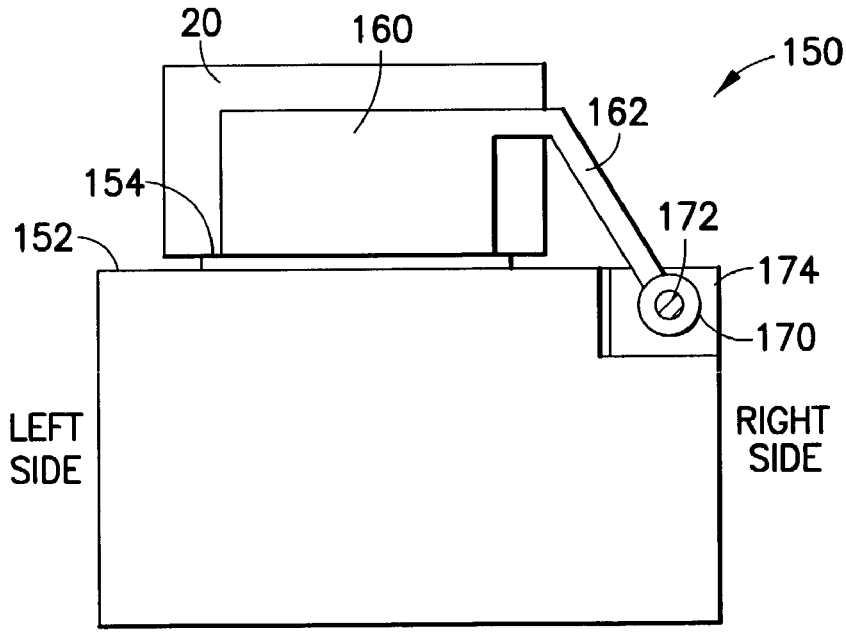
FIG. 3*a* is a schematic representation showing a front view of the stacking section in a mail stacking machine, according to the present invention.
Figure 3B:
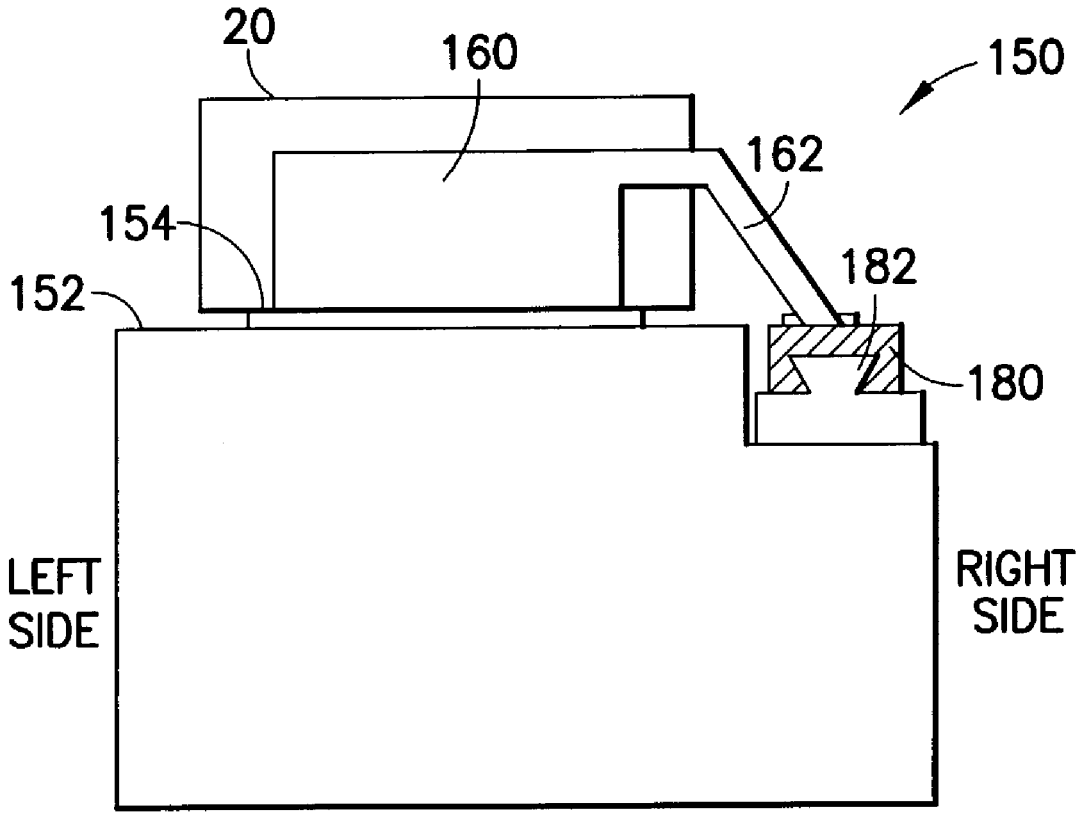
FIG. 3*b* is a schematic representation showing a front view of another embodiment of the stacking section in a mail stacking machine, according to the present invention.

When it is desirable to take the stacked mail off the stacking machine from either side of the stacking deck, the stacker paddle and its support should not unnecessarily hinder the sweeping of the mail stack. Thus, the support rod for the paddle should be positioned in a less intrusive way. FIGS. 3*a* and 3*b* show a front-view of the stacking section in a stacking machine, according to the present invention.

Figure 1:
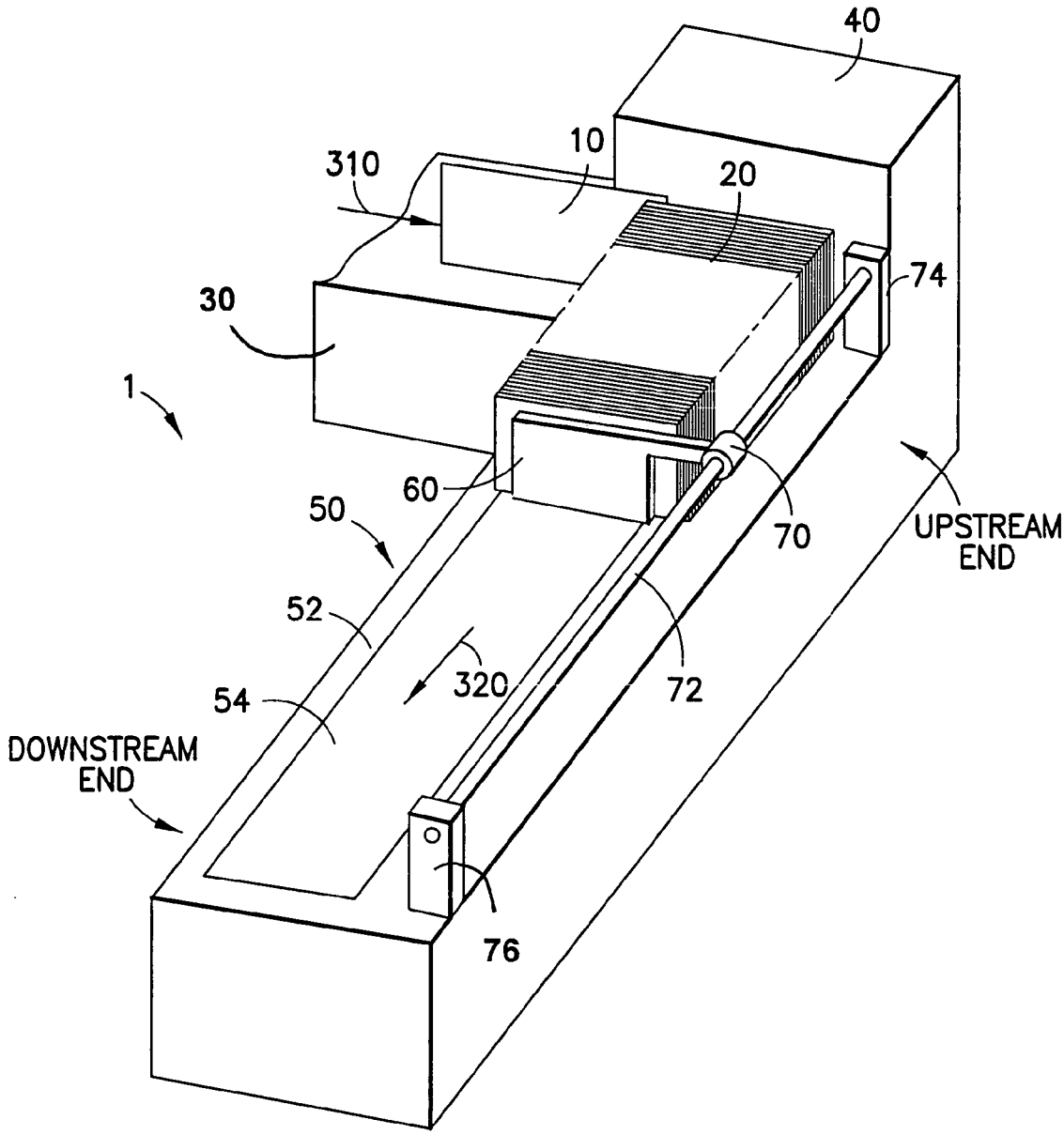
FIG. 1 PRIOR ART
FIG. 1 is a schematic representation showing an isometric view of a prior art on-edge mail stacking machine.
Figure 2:
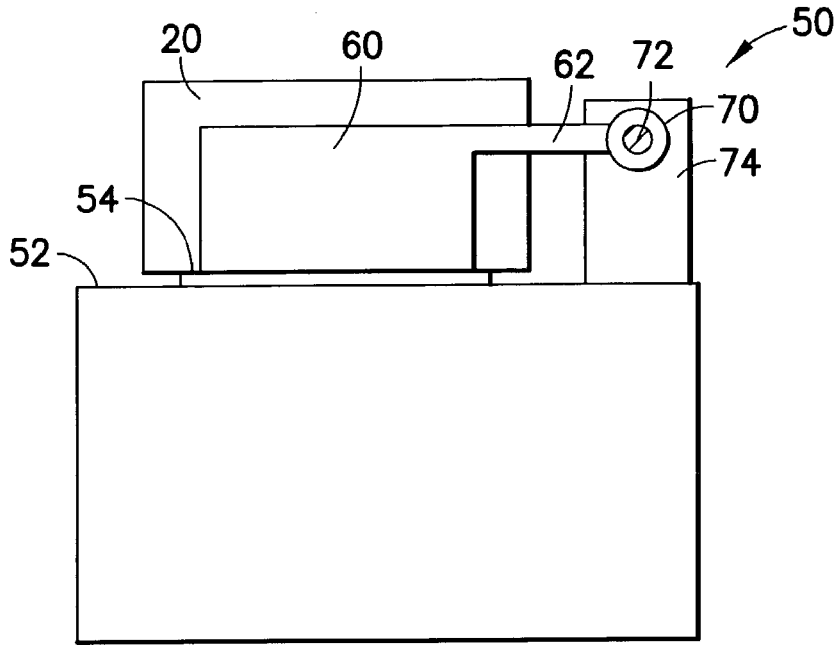
FIG.2 PRIOR ART
FIG. 2 is a schematic representation showing a front view of a prior art stacking section.

In the prior art stacking section 50, as shown in FIG. 2, the support rod 72 is positioned at a height above the surface of the deck 52. In contrast, in the stacking section 150 of the present invention, as shown in FIG. 3*a,* the support rod 172 for the paddle 160 is positioned below the deck surface 152, or positioned substantially at the level of the deck surface 152. As such, stacked mail can be swept either from the left longitudinal side or the right longitudinal side of the stacking section 150.

Figure 4:
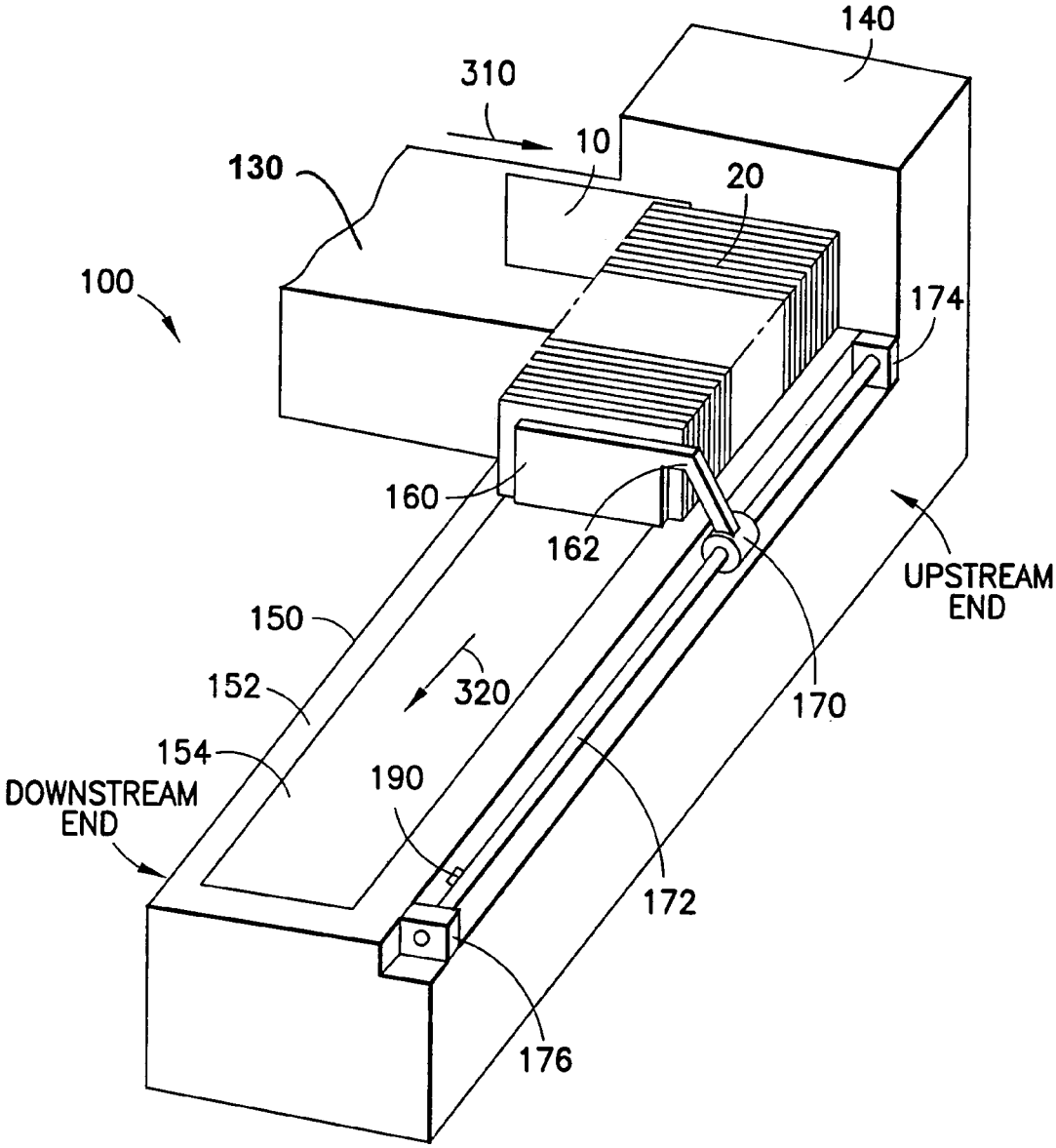
FIG. 4 is a schematic representation showing an isometric view of the mail stacking machine, according to the present invention.

The lowered support rod 172 is better viewed in the schematic representation of FIG. 4. As shown in FIG. 4, the stacking machine 100 of the present invention comprises a mailpiece input device 130, and an incoming mailpiece moving device 140 linking with the stacking section 150 to supply incoming mailpieces 10. As shown in FIG. 4, the stacking section 150 has a deck surface 152 to support a stack of mailpieces 20. A continuous conveyor belt 154 moves along the direction 320 to relieve the stack pressure as more mailpieces 10 form the stack 20. As shown in FIG. 4, the lowered support rod 172 is a linear rod running substantially parallel to the moving direction 320 of the conveyor belt 154. The paddle 160 is linked to a linear bearing collar 170 via a paddle handle 162 for movement, as shown in FIG. 3*a*. However, the support rod 172 can also be in a form a linear track, rail or the like. The linear track 182 and a slidable member 180 linking the paddle 160 are shown in FIG. 3*b*.

The lowered support rod 172 is mounted on rod mounts 174 and 176, which limit the movement of the linear collar 170 and hence the paddle 160. Thus, when the stack 20 expands toward the downstream end of the stacking section 150 and the bearing collar 170 touches the rod mount 176, the pressure on the mail stack 20 increases. It may be necessary to sweep the stacked mail when the stacking section is "full" and there is no room for the mail stack 20 to expand. Advantageously, a switch is installed near the downstream end of the stacking section 150 to alert the operator that the mail stack 20 is full or almost full. To that end, a toggle switch 190 or the like can be used. Preferably, the toggle switch 190 is fixedly mounted on the stacking section 150 adjacent to the rod mount 176.

Figure 5:
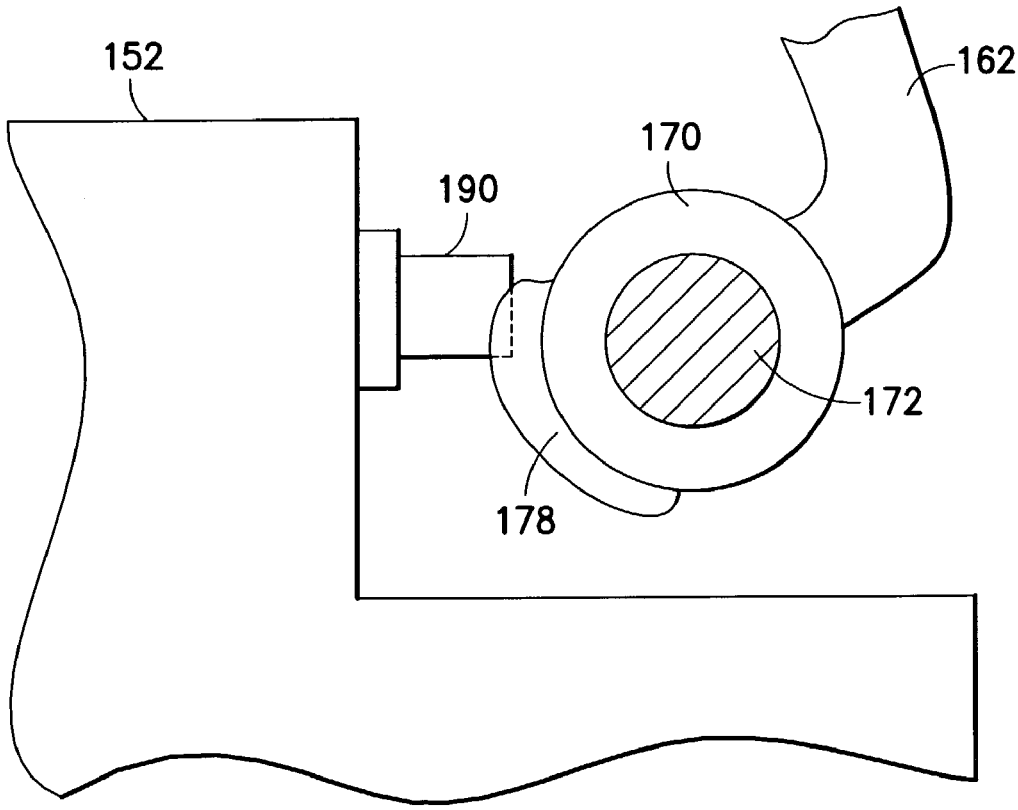
FIG. 5 is a schematic representation showing a cam surface on the paddle bearing collar being used to trip a rocker switch.

As shown in FIG. 5, the toggle switch 190 is designed to be tripped by a cam surface 178, which is extended from one end of the linear collar 170. The toggle switch 190 is tripped only by the cam surface 178 as the paddle 160 is indexing the conveyor belt 154 and the stacking deck is almost full. When the paddle 160 returns to the upstream end after the stacked mail is swept, the toggle switch 190 is "reset" in order to indicate that the deck surface 152 is no longer full. Advantageously, the toggle switch 190 is configured to "remember" its switch position even when the machine is turned off and on again.

Figure 6A:
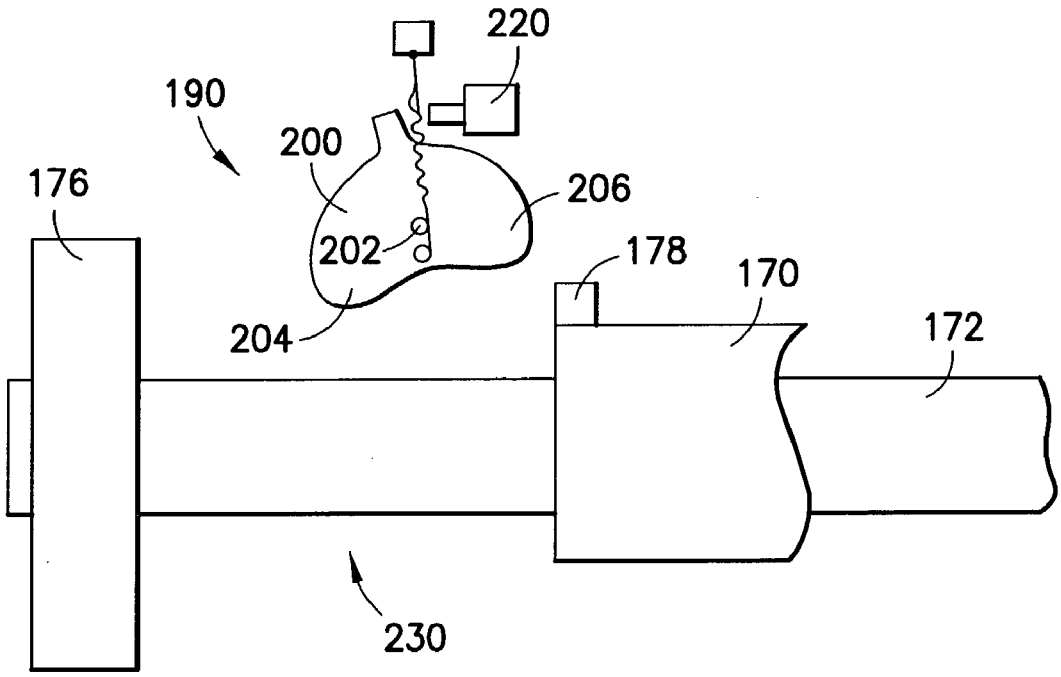
FIG. 6*a* is a schematic representation showing the rocker switch being tripped by the cam surface when the mail stack is almost full.
Figure 6B:
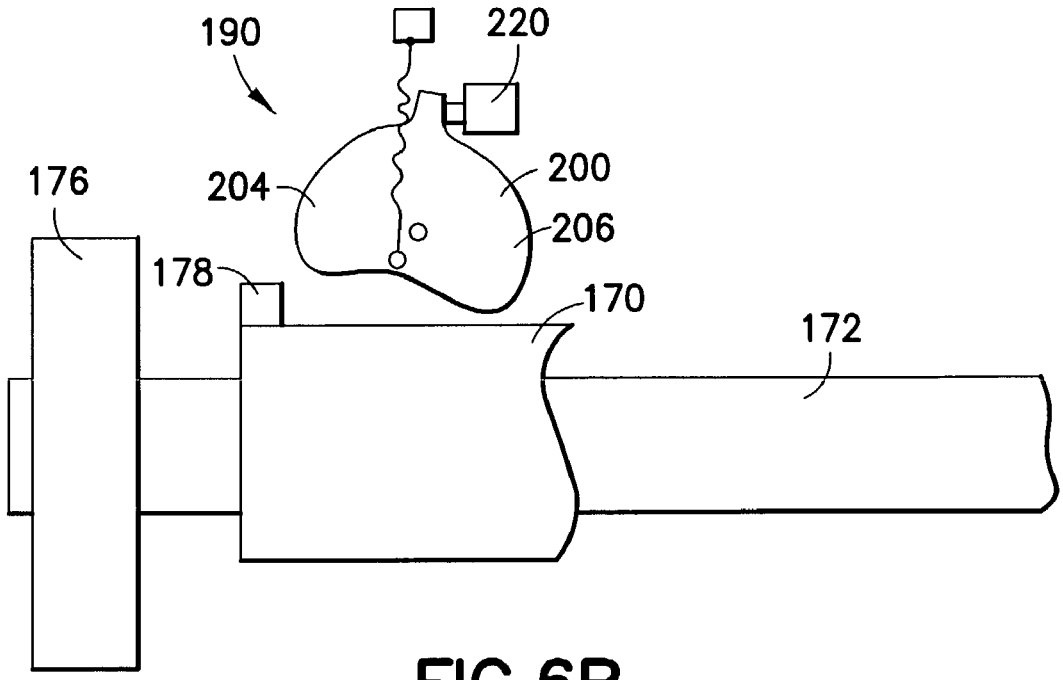
FIG. 6*b* is a schematic representation showing the rocker switch being reset, indicating that the stack is not full.

An example of the toggle switch 190 is shown in FIGS. 6*a* and 6*b*. As shown, the toggle switch 190 comprises a mechanical rocker switch 200 interacting with a contact switch 220. The rocker switch 200 has an actuating tip 210 to engage with the contact switch 220. The rocker switch 200 also has a left end 204 and a right end 206 to allow the cam surface 178 to change the position of the actuating tip 210. The rocker switch 200 is rotatably mounted at a pivot 202 so that the actuating tip 210 can be located at a first position to engage with the contact switch 220, as shown in FIG. 6*b*, or at a second position to disengage from the contact switch 220, as shown in FIG. 6*a*.

It should be understood that FIGS. 6*a* and 6*b* are only schematic representations showing the top view of the toggle switch 190 in relation to the support rod 172 and the linear collar 170 when the linear collar 170 is adjacent to the rod mount 176. The rod mount 176 is located at the downstream end of the stacking section 150. FIG. 6*a* illustrates a situation when the stacker 150 is still not full, and thus the actuating tip 210 is located at the second position. The contact switch 220, as illustrated in FIG. 6*a*, is in an "open" state.

As the mail stack 20 expands, the linear collar 170 moves toward the rod mount 176 beyond a point 230. When the cam surface 178 passes the rocker switch 200, it pushes the left end 204 outward, causing the actuating tip 210 to change position. As such, the actuating tip 210 engages with the contact switch 220, as shown in FIG. 6*b*. The contact switch 220, as illustrated in FIG. 6*b*, is in a "closed" state. A spring 198 is used as an overcenter mechanism to retain the toggle position of the rocker switch 200. After the stacked mail is unloaded from the stacking section 150, the paddle 160 returns to its home position near the upstream end. As the linear collar 170 moves past the rocker switch 200 toward the upstream end, the cam surface 178 pushes the right end 206 outward, thereby disengaging the actuating tip 210 from the contact switch 220 and returning the contact switch to its "open" state. Because the position of the rocker switch 200 is retained by the spring 198, the position is not affected by the stacking machine 100 being turning on or off. Such a toggle switch overcomes the inherent problem with electrical switches that do not properly reset if the machine is turned off or otherwise serviced. With the toggle switch 190, the stacking machine 100 always "knows" whether the stacking section 150 is full or not full. The contact switch 220 can be operatively linked to a control panel (not shown) where the operator can be informed of the stacking situation.

As the paddle 160 is frequently raised for mail sweeping and dropped back onto the stacking deck afterward, it is desirable to provide a blade 161 for the paddle 160 that would reduce the damage to the mailpieces in the slicing action. Preferably, the paddle 160 has a first wedge-shaped lower edge section 164. The first lower edge section 164 is located closer to the paddle handle 162 than a second lower edge section 166, and the first lower edge section 164 is the first to slice into the mail stack 20.

Figure 7A:
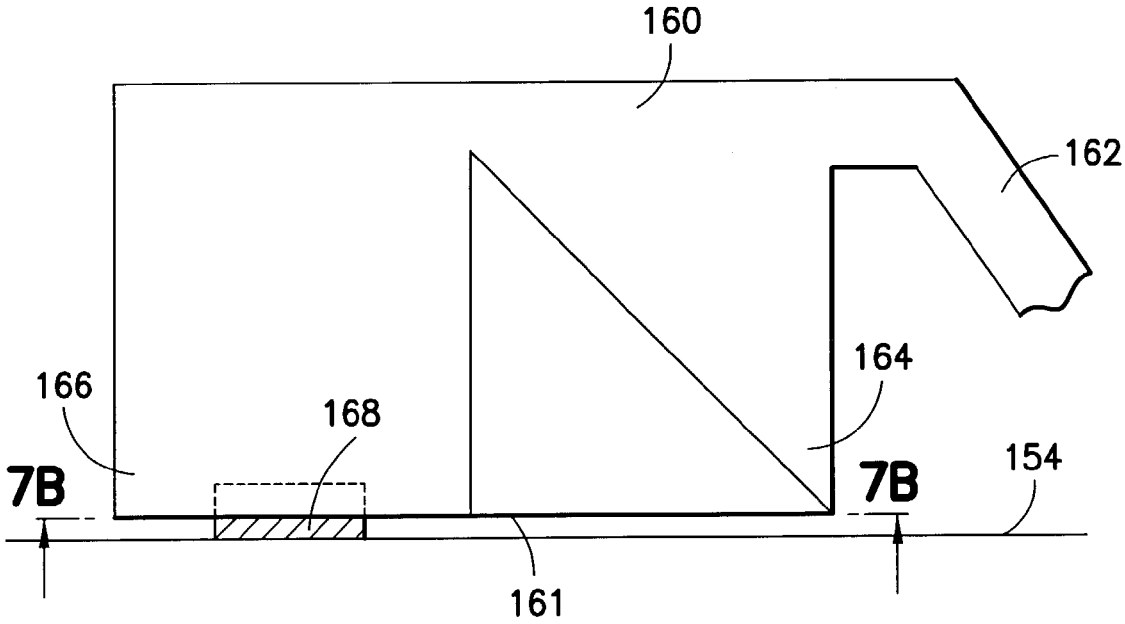
FIG. 7*a* is a schematic representation showing a front view of the paddle, according to the present invention.
Figure 7B:
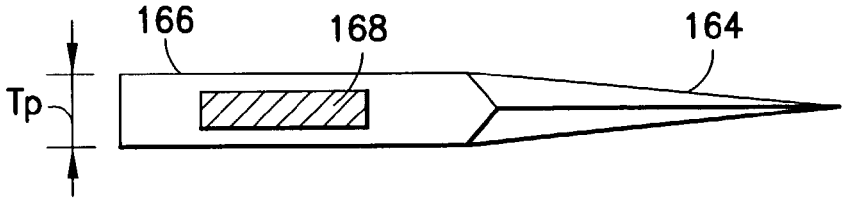
FIG. 7*b* is a schematic representation showing a bottom view of the paddle, according to the present invention.

The wedge-shaped edge 164 is illustrated in FIGS. 7*a* and 7*b*. In addition, a high-function elastomeric pad or grommet 168 is disposed on the second lower edge section 166. The pad 168 protrudes slightly from the second lower edge 166, as shown in FIG. 7*a*, so that the pad 168 can frictionally engage the conveyor belt 154. This allows the paddle 160 to index with the conveyor belt 154, thereby maintaining a consistent stack pressure at the top of the mail stack 20. As shown in FIG. 7*b*, the thickness of the pad 168 is smaller than the thickness $T_P$ of the second lower edge section 166 so that the pad 168 is contained within the paddle 160.

Although the invention has been described with respect to a preferred embodiment thereof, it will be understood by those skilled in the art that the foregoing and various other changes, omissions and deviations in the form and detail thereof may be made without departing from the scope of this invention.

What is claimed is:

1. A stacking machine for stacking a plurality of mailpieces into a stack, said stacking machine comprising:

a stacking deck having an upstream end, a downstream end, a horizontal deck surface to support the stack, the stack having a first end and an opposing second end adjacent to the upstream end, wherein the mailpieces in the stack are oriented in a direction substantially perpendicular to the deck surface, and wherein the mailpieces are driven into the second end of the stack for stacking, causing the stack to expand in an expansion direction from the upstream end toward the downstream end;

a first longitudinal side, and a second longitudinal side, the first and second longitudinal sides being free of vertical barriers as so to allow at least part of the stack to be removed from the deck surface either from the first or second longitudinal side;

a support member having a longitudinal axis substantially parallel to the expansion direction of the stack, disposed on the first longitudinal side of the stacking deck; and a paddle, movably disposed on the support member, for supporting the first end of the stack, the paddle thereby is caused to move with the stack along the longitudinal axis of the support member as the stack expands, wherein the paddle is disengageable from the stack when said at least part of the stack is removed from the deck surface, and wherein the support member is disposed at a level lower than or substantially the same as the deck surface so as to facilitate the removal of said at least part of the stack from the deck surface from the first longitudinal side thereof.

2. The stacking machine of claim 1, wherein the support member comprises a linear rod, and the paddle comprises a sliding member slidably mounted on the linear rod for linear movement along the longitudinal axis.

3. The stacking machine of claim 1, wherein the support member comprises a linear track, and the paddle comprises a sliding member slidably mounted on the linear track for linear movement along the longitudinal axis.

4. The stacking machine of claim 1, further comprising a mechanism, operable either in a first position or a second position and adapted to indicate that the paddle is located near the downstream end beyond a pre-determined point, wherein the mechanism is caused by the paddle to operate in the first position when the paddle moves from the upstream end toward the downstream beyond the pre-determined point, and in the second position when the paddle returns from the downstream end beyond the pre-determined point to the upstream end.

5. The stacking machine of claim 1, further comprising a moving belt disposed above and adjacent the deck surface for supporting and moving the mailpieces in the stack from the upstream end toward the downstream as the stack expands, wherein the paddle has an edge, resting on the moving belt when the paddle is engaged with the stack, the edge having an elastomeric surface to index the moving belt surface.

6. The stacking machine of claim 5, wherein the edge has a first edge end adjacent to the first longitudinal side of the stacking deck and a second edge end adjacent to the second longitudinal side, and wherein the edge is narrower in the first edge end than the second edge end.

* * * * *